US005252039A

United States Patent [19]

Mangyo et al.

[11] Patent Number: 5,252,039

[45] Date of Patent: Oct. 12, 1993

[54] ENCLOSED MOTOR-DRIVEN COMPRESSOR

[75] Inventors: Masao Mangyo; Hideki Kawai; Satoshi Wada, all of Fujisawa; Masahiko Osaka, Chigasaki, all of Japan

[73] Assignee: Matsushita Refrigeration Co., Osaka, Japan

[21] Appl. No.: 801,567

[22] Filed: Dec. 2, 1991

[30] Foreign Application Priority Data

| | | | |
|---|---|---|---|
| Feb. 5, 1991 | [JP] | Japan | 3-014348 |
| Apr. 22, 1991 | [JP] | Japan | 3-090511 |
| Jul. 3, 1991 | [JP] | Japan | 3-162742 |

[51] Int. Cl.[5] ..... F04B 39/02

[52] U.S. Cl. ..... 417/368; 184/6.16

[58] Field of Search ..... 417/366, 368; 184/6.16, 184/6.18

[56] References Cited

U.S. PATENT DOCUMENTS

| | | | |
|---|---|---|---|
| 1,990,305 | 2/1935 | Myers | 184/6.18 |
| 2,738,122 | 3/1956 | Gardiner | 417/415 |
| 2,875,850 | 3/1959 | Glass | 184/6.16 |
| 3,248,044 | 4/1966 | Parker | 417/372 |
| 3,663,127 | 5/1972 | Cheers | 417/415 |
| 3,807,907 | 4/1974 | Gannaway | 417/415 |
| 4,063,853 | 12/1977 | De Grant | 417/368 |
| 4,396,361 | 8/1983 | Fraser | 417/368 |
| 4,597,720 | 7/1986 | Friedrichs | 417/368 |
| 4,632,644 | 12/1986 | Fritchman | 417/415 |
| 4,700,808 | 10/1987 | Maentjens | 184/6.18 |
| 5,038,891 | 8/1991 | Wallis | 417/368 |
| 5,046,930 | 9/1991 | Lindstrom | 417/366 |

FOREIGN PATENT DOCUMENTS

| | | |
|---|---|---|
| 1751954 | 9/1971 | Fed. Rep. of Germany . |
| 2351286 | 12/1977 | France . |
| 63-5186 | 6/1988 | Japan . |
| 578486 | 11/1977 | U.S.S.R. . |

*Primary Examiner*—Richard A. Bertsch
*Assistant Examiner*—Peter Korytwyk
*Attorney, Agent, or Firm*—Lowe, Price, LeBlanc & Becker

[57] ABSTRACT

An enclosed motor-driven compressor includes a vertical crankshaft rotatably supported by two ball bearings and having an eccentric portion through which a motor element and a compressor element are operatively connected. The two ball bearings are disposed on opposite sides of the eccentric portion so that a reaction force of a piston which is exerted on the eccentric portion is supported evenly by the ball bearings. With the ball bearings thus arranged, the load on the crankshaft is lowered and the efficiency of the motor element is increased. A lubricating oil held at the bottom of a container is sucked through an internal groove of the crankshaft and then supplied from outlets to the respective ball bearings. The ball bearings thus lubricated have a prolonged service life. The compressor may have an oil sump disposed either above or below the ball bearing for improving lubricating condition of the ball bearing.

9 Claims, 7 Drawing Sheets

ENCLOSED MOTOR-DRIVEN COMPRESSOR

BACKGROUND OF THE INVENTION

1. Field of the Invention

The present invention relates to an enclosed motor-driven compressor for use in a refrigerator or the like.

2. Description of the Prior Art

In recent years, there has been an increased demand for a highly efficient enclosed motor-driven compressor (hereinafter referred to as "compressor") from the viewpoint of increasing the energy efficiency. The efficiency of the compressors has been increased to a certain high level, however, a further improvement is needed.

Japanese Patent Laid-open Publication No. 63-5186 exemplifies one conventional compressor which includes, as shown here in FIG. 5, a closed container 1 within which a motor element 2 and a compressor element 3 are resiliently supported. The motor element 2 is composed of a stator 4 and a rotor 5. The rotor 5 has a central hole in which a crankshaft 6 is firmly fitted. The crankshaft 6 is rotatably supported by a pair of ball bearings 7 and 8 mounted in a housing 9. The ball bearings 7 and 8 are press-fitted over the crankshaft 6 and retained at predetermined positions, respectively, within a stepped bore in the housing 9. The housing 9 is secured to a cylinder block 10 by a plurality of screws 11 (only one shown). A lubricating oil 12 is held at the bottom of the container 1. Though not shown, the crankshaft 6 has an axial groove connected at one end (inlet) to an oil feed pipe 13 immersed in the lubricating oil 12, the opposite end (outlet) of the axial groove opening at a portion of the crankshaft 6 which is disposed above the ball bearing 7 for a purpose described below. The crankshaft 6 is connected by a connecting rod 14 to a piston 15 slidably received in a cylinder bore 16 in the cylinder block 10.

In operation, when the motor element 2 is energized to start operation of the compressor of the foregoing construction, the rotor 5 and the crankshaft 6 rotate. Since the crankshaft 6 is connected to the piston 15 by the connecting rod 14, a rotary motion of the crankshaft 6 is changed into a reciprocating motion of the piston 15 which in turn compresses a refrigerating agent trapped in the gaseous state within a compression chamber defined between the cylinder block 10 and the piston 15. The lubricating oil 12 is sucked by a centrifugal force from the oil feed pipe 13, then flows upward along the axial groove in the crankshaft 6, and finally supplied from the outlet of the axial groove onto the ball bearing 7 and thence to the ball bearing 8.

Since the crankshaft 6 of the conventional compressor is supported only at one side with respect to a point of application of a reaction force of the compression load of the piston 15 (i.e., the crankshaft 6 has a cantilevered or overhanging structure), the reaction force W of the compression load acts on the ball bearings 7 and 8 in the manner diagrammatically shown in FIG. 6. As is apparent from FIG. 6, a load exerted on the ball bearing 8 is represented by $L/l_2 \cdot W$ where L is the distance between the point of application of the reaction force W and the ball bearing 7, $l_2$ is the distance between the ball bearing 7 and the ball bearing 8, and W is the reaction force of the compression load of the piston 15. Likewise, a load acting on the ball bearing 7 is represented by $l_1/l_2 \cdot W$ where l is the distance between the ball bearing 8 and the point of application of the reaction force W, $l_2$ is as defined above, and W is as defined above. This means that the load acting on the ball bearing 8 exceeds the reaction force W. On the other hand, the load on the ball bearing 7 is smaller than the reaction force W but it still has a relatively large magnitude. With this distribution of bearing loads, the ball bearings 7 and 8 have a relatively short service life and hence are difficult to provide a sufficient degree of reliability. in addition, since the direction of the load acting on the ball bearing 7 is opposite to the direction of the load on the ball bearing 8, and due to the presence of internal radial clearances of the respective ball bearings 7 and 8, the rotor 5 while it is rotating tends to vibrate in a precessional manner. With this precessional vibration, a gap between the stator 4 and rotor 5 cannot be maintained uniformly, so that the motor efficiency tends to fluctuate.

In addition, since it takes about several seconds before the lubricating oil 12 reaches the ball bearings 7 and 8, the ball bearings 7 and 8 may be marked with scars or dents before they are lubricated. the ball bearings 7 and 8 thus damaged have a short service life and cannot operate stably and reliably.

Japanese Patent Laid-open Publication No. 63-134872 discloses another conventional compressor which comprises, as shown in FIG. 7, a corrugated spring washer 16 disposed, in a somewhat distorted state, between an outer race 8*a* of the ball bearing 8 and the housing 9, and a sleeve 17 fitted over the crankshaft 6 and held in contact with an inner race of the ball bearing 7 to lock the crankshaft 6 in position against axial displacement relative to the ball bearings 7 and 8. These parts which correspond to those of the conventional compressor shown in FIG. 5 are designated by the same or corresponding characters, and a further description thereof will be omitted.

With the construction, the ball bearing 7 is subjected to a thrust load exerted by the spring washer 16 in addition to the weight of the rotor 5 and the crankshaft 6, while the ball bearing 8 is subjected to the thrust load from the spring washer 16. The spring washer 16 serves to lighten the influence of the weight of the rotor 5 and the crankshaft 6 on the ball bearings 7 and 8 so as to lower the sliding noise of the ball bearings 7 and 8. The last-mentioned conventional compressor also has the low motor efficiency problem and the insufficient lubrication problem that are mentioned above with respect to the compressor disclosed in the first-mentioned Japanese publication.

SUMMARY OF THE INVENTION

It is accordingly an object of the present invention to provide an enclosed motor-driven compressor incorporating structural features which are able to lower the bearing load and increase the efficiency of a motor element of the compressor.

Another object of the present invention is to provide an enclosed motor-driven compressor which is capable of operating silently and reliably with high efficiency and which has a long bearing life.

An enclosed motor-driven compressor of this invention comprises a motor element and a compressor element resiliently supported within a closed container, with the motor element disposed above the compressor element. A vertical crankshaft is firmly connected to a rotor of the motor element and has an eccentric portion through which the motor element and the compressor element are operatively connected. The crankshaft further has an internal oil feed passage having an inlet and an outlet. Lubricating oil is held at the bottom of the container. An oil feed pipe is provided at a lower end portion of the crankshaft and communicates at its one end with the inlet of the internal oil feed passage, the opposite end of the oil feed pipe being immersed in the lubricating oil. First and second ball bearings are disposed on opposite sides of the eccentric portion for rotatably supporting the crankshaft. The first ball bearing is disposed above the second ball bearing, and the outlet of the internal oil feed passage is disposed above the first ball bearing.

The internal oil feed passage may have a second outlet disposed immediately above the second ball bearing.

According to a preferred embodiment, the first ball bearing is received in a housing secured to a portion of the compressor element. The housing has a first oil sump disposed below the outlet for temporarily storing therein the lubricating oil supplied from the outlet, and at least one small oil feed passage communicating the first oil sump with running tracks of the first ball bearing for feeding the lubricating oil by gravity from the first oil sump to the running tracks of the first ball bearing. Preferably, the second ball bearing is partly immersed in the lubricating oil held at the bottom of the container.

According to another preferred embodiment, the crankshaft further has a dish-like second oil sump disposed immediately below the first ball bearing for receiving therein the lubricating oil flowing down from the first oil sump through the oil feed passage and through the first ball bearing. The dish-like second oil sump has a side wall flaring radially outwardly and upwardly toward the first ball bearing for scattering the lubricating oil onto the first ball bearing.

The above and other objects, features and advantages of the present invention will become more apparent from the following description when making reference to the detailed description and the accompanying sheets of drawings in which preferred structural embodiments incorporating the principles of the present invention are shown by way of illustrative examples.

DETAILED DESCRIPTION OF THE INVENTION

The present invention will be described below in greater detail with reference to certain preferred embodiments illustrated in the accompanying drawings.

Figure 1:
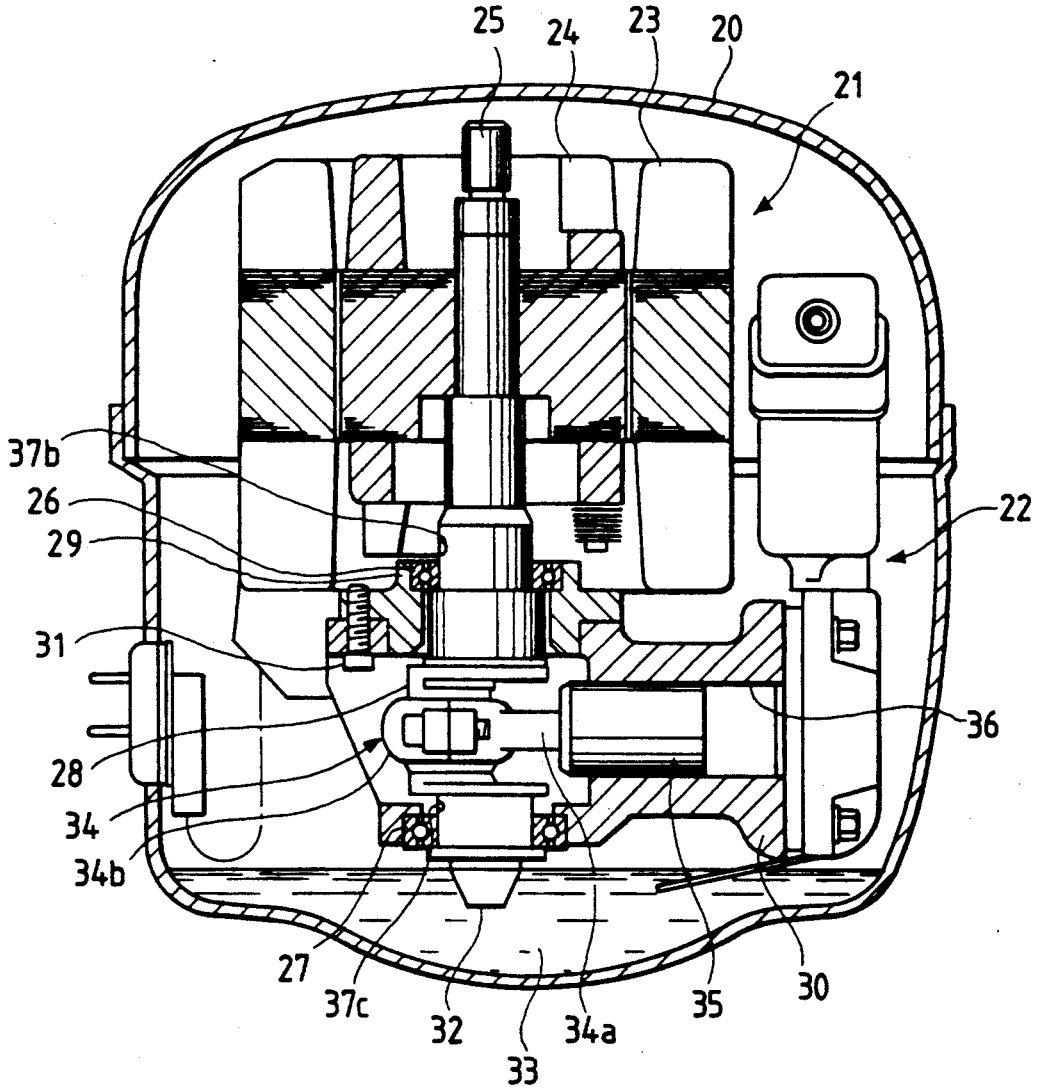
FIG. 1 is a cross-sectional view of an enclosed motor-driven compressor according to a first embodiment of this invention.

FIG. 1 shows, in cross section, an enclosed motor-driven compressor according to a first embodiment of this invention. The compressor includes a closed container 20 in which a motor element 21 and a compressor element 22 are resiliently supported. The motor element 21 is composed of a stator 23 and a rotor 24 rotatably received in the stator 23 with an air gap therebetween. The rotor 24 has a central hole in which a crankshaft 25 is firmly fitted. The crankshaft 25 is rotatably supported by first and second ball bearing 26 and 27 disposed on opposite sides of an eccentric portion 28 of the crankshaft 25. The first ball bearing 26 is located on the motor element 21 side of the eccentric portion 28 and supported by a housing 29 secured to a supporting portion (not designated) of a cylinder block 30 by a plurality of screws 31 (only one shown). The second ball bearing 27 is located on the container 20 side of the eccentric portion 28 and supported by the supporting portion of the cylinder block 30. The first and second ball bearings 26 and 27 are press-fitted over longitudinally spaced, concentric parts of a main portion of the crankshaft 25 and retained at predetermined positions by the housing 29 and the cylinder block 30, respectively. The crankshaft 25 is connected at its lower end to an oil feed pipe 32. The oil feed pipe 32 is immersed in a lubricating oil 33 stored at the bottom of the container 20. The eccentric portion 28 of the crankshaft 25 is connected by a connecting rod 34 to a piston 35 slidably received in a cylinder bore 36 in the cylinder block 30. The connecting rod 34 is of the separate type that can be assembled with the crankshaft 25 with utmost ease. More specifically, the connecting rod 34 is composed of a first portion 34*a* connected to the piston 30 and a second portion 34*b* connected by screws to the first portion 34*a* to join the connecting rod 34 to the eccentric portion 28 of the crankshaft 25.

Figure 2:
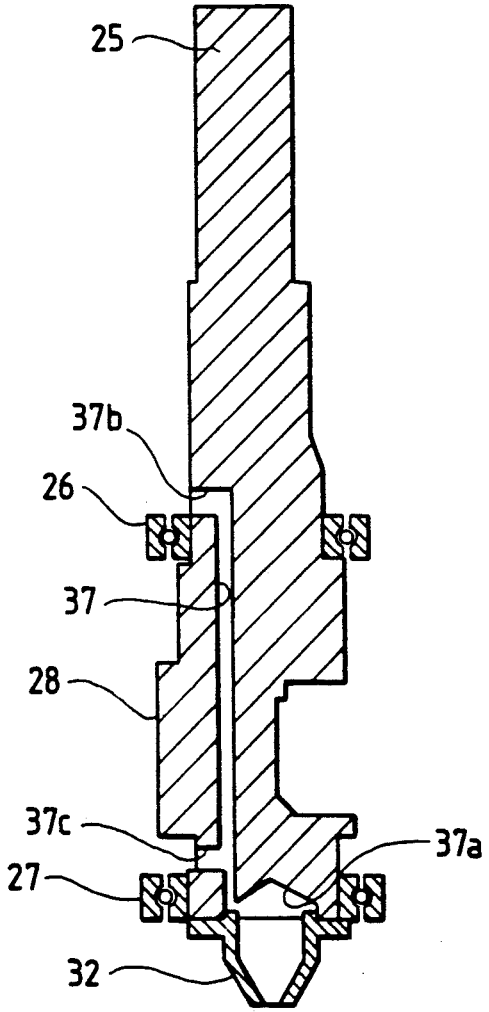
FIG. 2 is an enlarged longitudinal cross-sectional view of a crankshaft of the compressor.

As shown in FIG. 2, the crankshaft 25 has an axial internal groove 37 extending from the lower end toward the upper end of the crankshaft 25. The axial groove 37 has an inlet 37*a* in which the oil feed pipe 32 is press-fitted, and first and second outlets 37*b* and 37*c* opening at portions of a peripheral surface of the crankshaft 25 that are located immediately above the ball bearings 26 and 27, respectively.

In operation, the motor element 21 is energized to start operation of the compressor whereupon the rotor 24 and the crankshaft 25 rotate. A rotary motion of the crankshaft 25 is changed into a reciprocating motion of the piston 35 which in turn compresses a refrigerating agent trapped in the gaseous state within a compression chamber defined between the cylinder block 30 and the piston 35. The lubricating oil 33 is pumped up by a centrifugal force from the oil feed pipe 32, then flows upward along the axial groove 37 (FIG. 2) in the crankshaft 25, and finally supplied from the first and second outlets 37*b*, 37*c* onto the first and second ball bearings 26 and 27.

Figure 5:
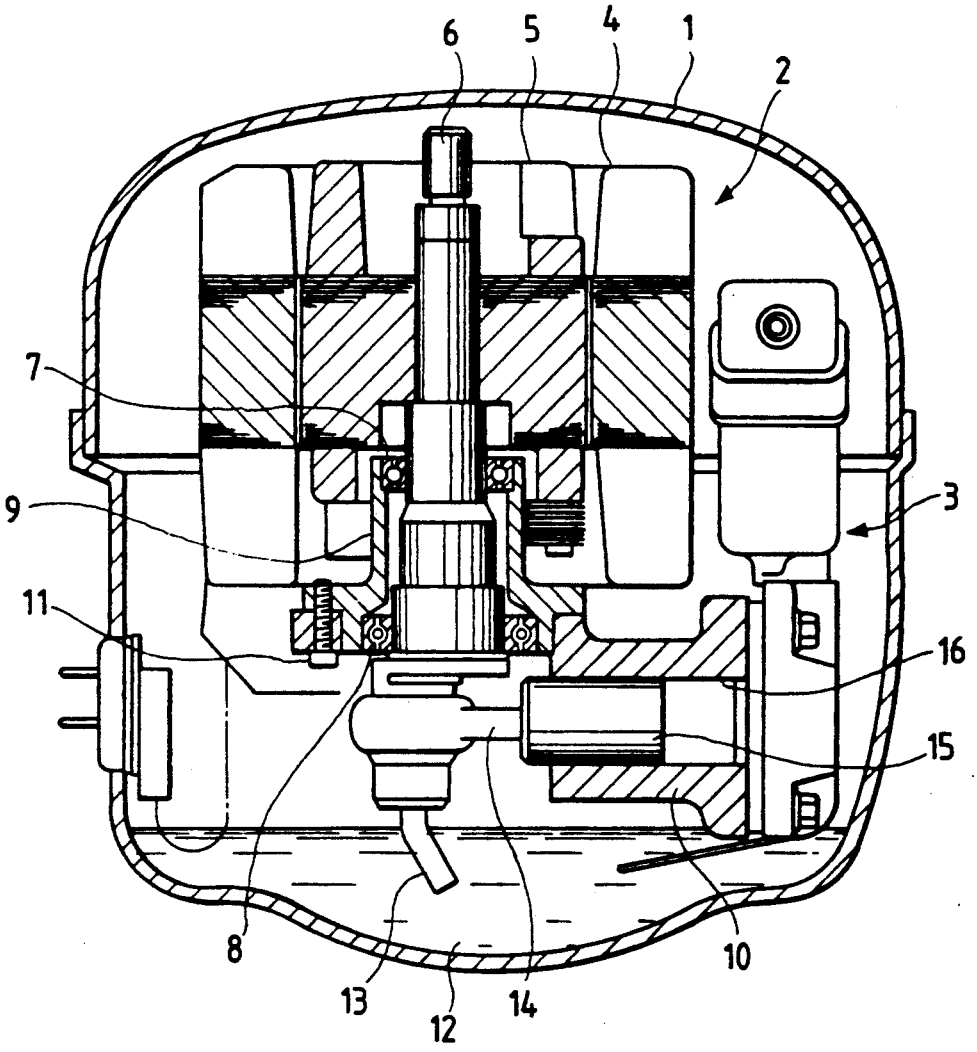
FIG. 5 PRIOR ART
FIG. 5 is a cross-sectional view of a conventional motor-driven compressor.
Figure 6:
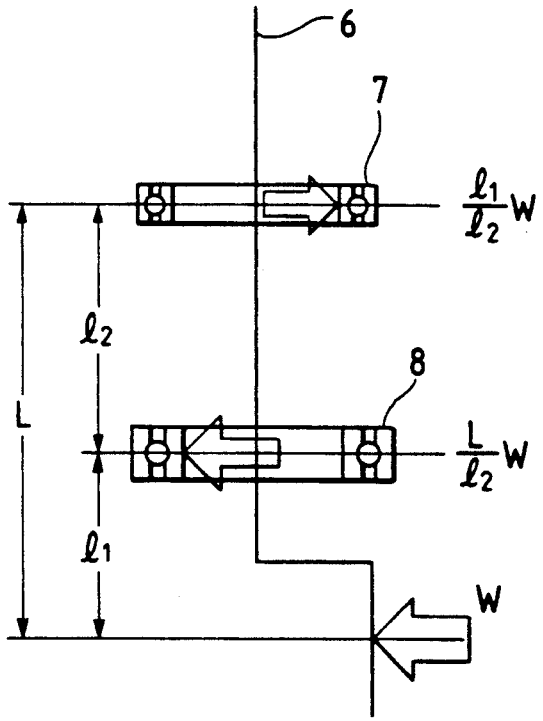
FIG. 6 PRIOR ART
FIG. 6 is a diagrammatical view illustrative of loads exerted on a crankshaft of the conventional compressor.
Figure 7:
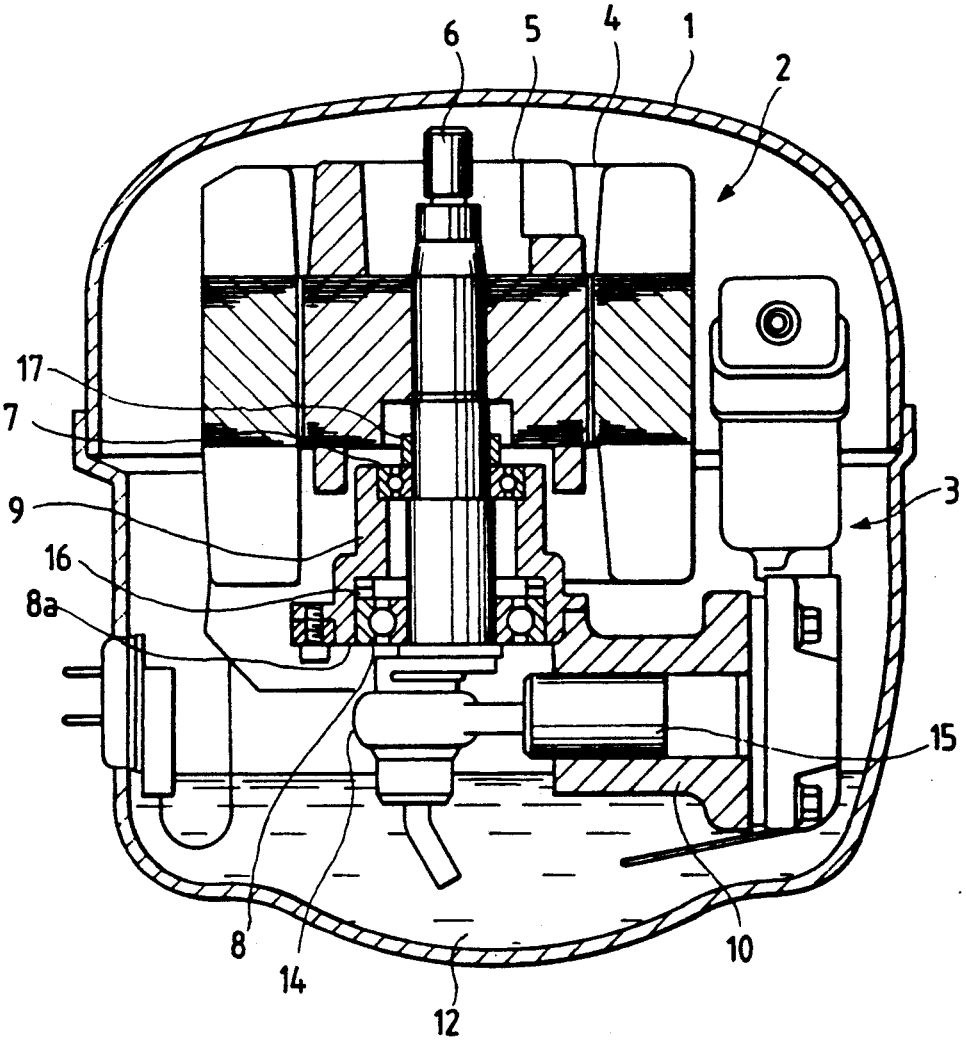
FIG. 7 PRIOR ART
FIG. 7 is a cross-sectional view of another conventional motor-driven compressor.

Since the first and second ball bearings 26 and 27 are disposed on opposite sides of the eccentric portion 28 of the crankshaft 25, a load which is produced in the form of a reaction force of compression load of the piston 35 is borne substantially evenly by the first and second ball bearings 26 and 27. Thus, the bearing load on the ball bearings 26, 27 is considerably reduced. In connection with is concerned the second ball bearing 27 is concerned, the bearing load is reduced to less than half of the bearing load exerted on the bearing 8 of the conventional compressor shown in FIG. 5.

In addition, the first and second ball bearings 26 and 27 are lubricated with the lubricating oil 33 which is supplied from the first and second outlets 37*b* and 37*c* located immediately above the respective ball bearings 26, 27. With the lubrication thus performed, the ball bearings 26 and 27 operates stably and reliably over a long service life.

Furthermore, the distance between the first and second ball bearings 26 and 27 can be enlarged as compared to the conventional compressor. In addition, the bearing loads exerted on the respective ball bearings 26, 27 have the same direction. With this arrangement, the air gap between the stator 23 and the rotor 24 is not affected very much by radial clearances provided in the respective ball bearings 26, 27. The air gap can, therefore, be maintained uniformly so that the motor efficiency is maintained stably at a high level.

Figure 3:
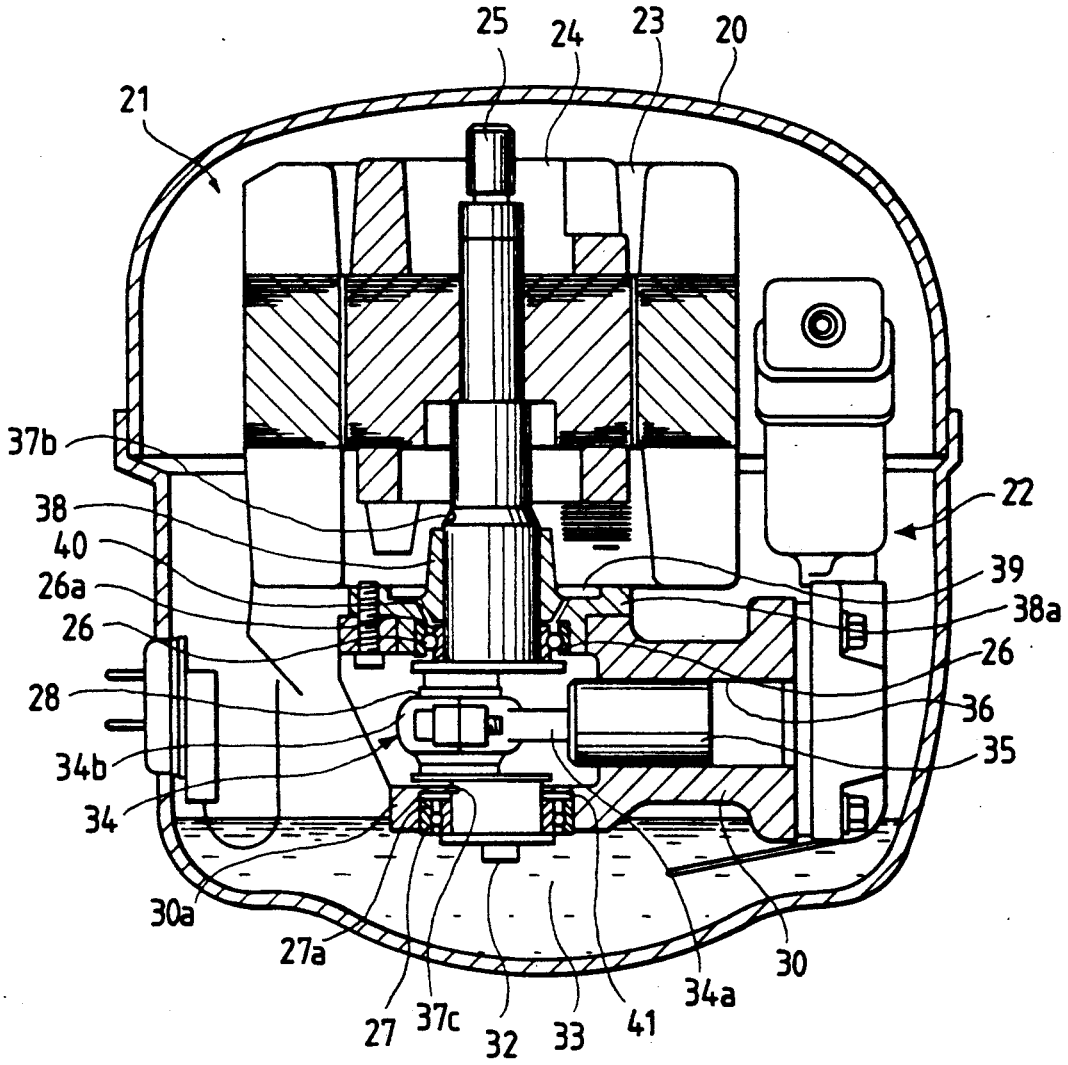
FIG. 3 is a cross-sectional view of an enclosed motor-driven compressor according to a second embodiment of this invention.

FIG. 3 is a cross-sectional view of shows an enclosed motor-driven compressor according to a second embodiment of this invention. This compressor is substantially the same as the compressor of the first embodiment shown in FIG. 1 except for the following features.

A housing 38 in which the first ball bearing 26 is received has an oil sump 39 formed in an upper surface of an annular flange 38*a* of the housing 38, and at least one small oil feed passage 40 (two in the illustrated embodiment) communicating the oil sump 39 with running tracks 26*a* of the first ball bearing 26 on and along which balls of the ball bearing 26 roll. The crankshaft 25 has an axial groove (though not shown but identical to the groove 37 shown in FIG. 2). A first outlet 37*b* of the axial groove is disposed above the oil sump 39. The second ball bearing 27 is received in a bearing supporting portion 30*a* of the cylinder block 30, with a corrugated spring washer 41 disposed between an outer race 27*a* of the ball bearing 27 and the bearing supporting portion 30*a*. The second outlet 37*c* of the axial groove is disposed immediately above the second ball bearing 27 but the second outlet 37 may be omitted because the second ball bearing 27 is partly immersed in the lubricating oil 33 held at the bottom of the container 20.

With this arrangement, when the motor element 21 is driven to operate the compressor, the rotor 24 and the crankshaft 25 rotate. The corrugated spring washer 41 disposed between the second ball bearing 27 and the cylinder block 30 serves to eliminate the influence of the weight of the rotor 24 and the crankshaft 25 on the ball bearings 26, 27. The lubricating oil 33 is sucked by a centrifugal force from the oil feed pipe 32, then flows upward along the axial groove (see FIG. 2) in the crankshaft 25, and finally supplied from the first and second outlets 37*b*, 37*c* onto the first and second ball bearings 26 and 27. In this instance, the lubricating oil 33 supplied from the first outlet 37*b* is temporarily stored in the oil sump 39 and then continuously supplied by gravity from the oil sump 39 through the oil feed passages 40 to the running tracks 26*a* of the first ball bearing 26. Running tracks (not designated) of the second ball bearing 27 are continuously lubricated with the lubricating oil 33 as the second ball bearing 27 is partly immersed in the lubricating oil 33 held at the bottom of the container 20. Since the diameter of the oil feed passages 40 is small so, that the lubricating oil 33 still remains by surface tension within the oil feed passages 40 after the operation of the compressor is stopped. As soon as the compressor is driven again, the lubricating oil 33 remaining in the oil feed passages 40 flows downward into the first ball bearing 26. The lubrication thus performed is particularly effective to lower the operation noise of the compressor and prolong the service life of the ball bearings 26, 27.

Figure 4:
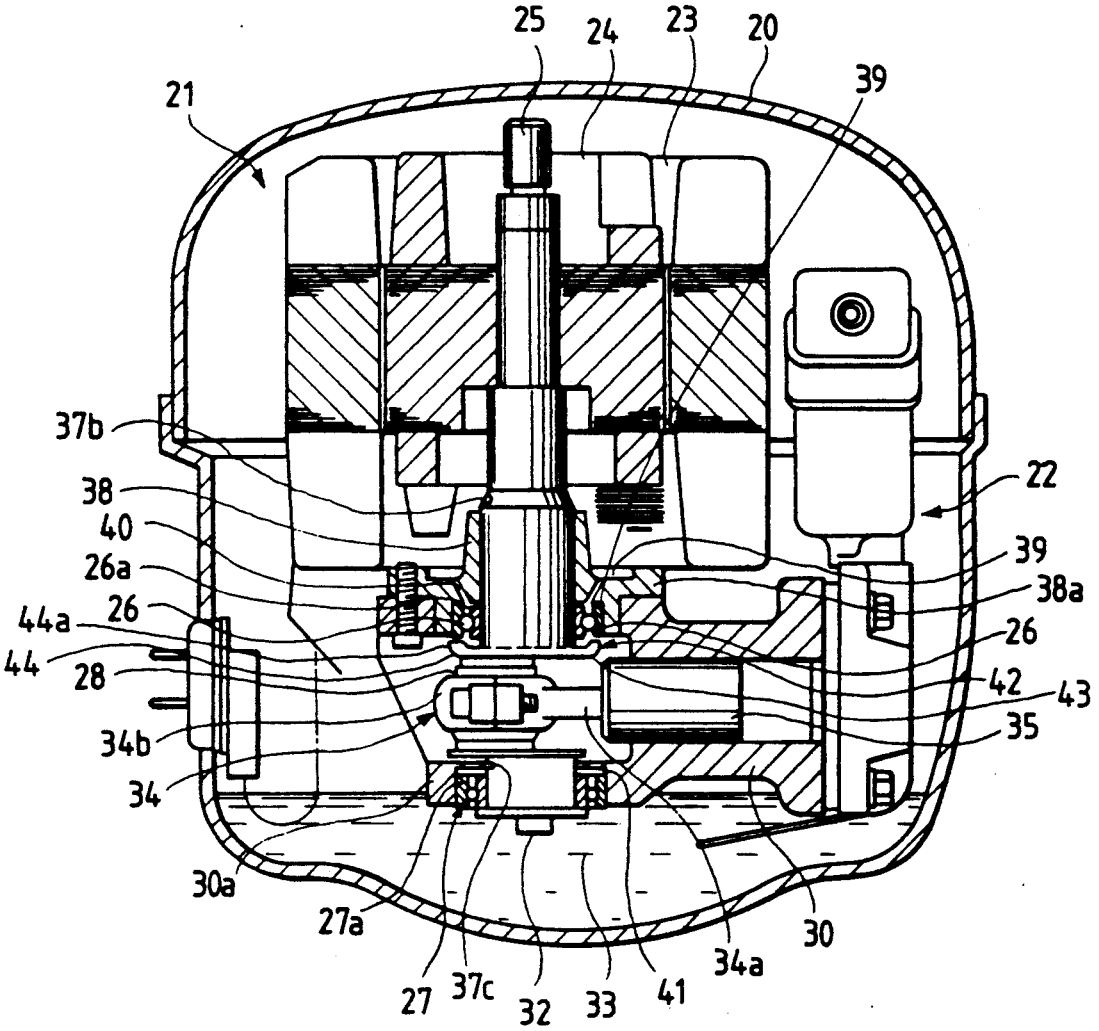
FIG. 4 is a cross-sectional view of an enclosed motor-driven compressor according to a third embodiment of this invention.

FIG. 4 shows, in cross section, an enclosed motor-driven compressor according to a third embodiment of this invention. The compressor is substantially the same as the compressor of the third embodiment shown in FIG. 3 with the exception that the crankshaft 25 includes a dish-like second oil sump 42 formed in an upper surface of an annular flange 43 of the crankshaft 25 disposed below the first ball bearing 26. The dish-like second oil sump 42 has an annular side wall 44 flaring radially outwardly and upwardly toward the first ball bearing 27 and having an outer peripheral edge 44*a* disposed immediately below the first ball bearing 26.

With this construction, the lubricating oil 33 flowing downward from the first oil sump 39 passes through the oil feed passages 40 and through the first ball bearing 26 and then is stored into the second oil sump 42. The lubricating oil 33 retained in the second oil sump 42 is splashed or scattered onto the first ball bearing 26 due to centrifugal force produced during rotation of the crankshaft 25. In addition to the lubricating oil 33 remaining within the small oil feed passages 40, the lubricating oil 33 stored within the second oil sump 42 is used to lubricate the first ball bearing 26 immediately after the operation of the compressor is started. With this lubrication, a further reduction of the operation noise of the compressor and a further extension of the service life of the ball bearings 26, 27 can be attained.

Obviously, various minor changes and modifications of the present invention are possible in the light of the above teaching. It is therefore to be understood that within the scope of the appended claims the invention may be practiced otherwise than as specifically described.

What is claimed is:

1. An enclosed motor-driven compressor, comprising:

a closed container;

a motor element and a compressor element resiliently supported within said container, with said motor element disposed above said compressor element;

a vertical crankshaft firmly connected to a rotor of said motor element and having an eccentric portion through which said motor element and said compressor element are operatively connected, said crankshaft further having an internal oil feed passage having an inlet and an outlet;

a lubricating oil held at the bottom of said container;

an oil feed pipe provided at a lower end portion of said crankshaft and communicating at its one end with said inlet of said internal oil feed passage, the opposite end of said oil feed pipe being immersed in said lubricating oil; and first and second ball bearings disposed on opposite sides of said eccentric portion for rotatably supporting said crankshaft, said first ball bearing being disposed above said second ball bearing, said outlet of said internal oil feed passage being disposed above said first ball bearing, wherein said crankshaft further has a dish-like oil sump disposed immediately below said first ball bearing for receiving therein said lubricating oil flowing down from said outlet through said first ball bearing, said dish-like oil sump having a side wall flaring radially outwardly and upwardly toward said first ball bearing.

2. The enclosed motor-driven compressor of claim 1, wherein said internal oil feed passage has a second outlet disposed immediately above said second ball bearing.

3. An enclosed motor-driven compressor according to claim 1, wherein said internal oil feed passage has a second outlet disposed immediately above said second ball bearing.

4. An enclose motor-driven compressor, comprising:

a closed container;

a motor element and a compressor element resiliently supported within said container, with said motor element disposed above said compressor element;

a vertical crankshaft firmly connected to a rotor of said motor element and having an eccentric portion through which said motor element and said compressor element are operatively connected, said crankshaft further having an internal oil feed passage having an inlet and an outlet;

a lubricating oil held at the bottom of said container;

an oil feed pipe provided at a lower end portion of said crankshaft and communicating at its one end with said inlet of said internal oil feed passage, the opposite end of said oil feed pipe being immersed in said lubricating oil; and first and second ball bearings disposed on opposite sides of said eccentric portion for rotatably supporting said crankshaft, said first ball bearing being disposed above said second ball bearing, said outlet of said internal oil feed passage being disposed above said first ball bearing, wherein said first ball bearing is received in a housing secured to a portion of said compressor element, said housing having a first oil sump for temporarily storing therein the lubricating oil, and ate least one small oil feed passage communicating said first oil sump with running tracks of said first ball bearing for feeding the lubricating oil by gravity from said first oil sump to said running tracks of said first ball bearing, said outlet of said internal oil feed passage being disposed above said first oil sump.

5. An enclosed motor-driven compressor according to claim 4, wherein said internal oil feed groove has a second outlet disposed immediately above said second ball bearing.

6. An enclosed motor-driven compressor according to claim 4, wherein said second ball bearing is partly immersed in said lubricating oil held at the bottom of said container.

7. An enclosed motor-driven compressor according to claim 4, wherein said crankshaft further includes a dish-like second oil sump disposed immediately below said first ball bearing for receiving therein said lubricating oil flowing down from said first oil sump through said oil feed passage and through said first ball bearing, said dish-like second oil sump having a side wall flaring radially outwardly and upwardly toward said first ball bearing.

8. An enclosed motor-driven compressor according to claim 7, wherein said internal oil feed groove has a second outlet disposed immediately above said second ball bearing.

9. An enclosed motor-driven compressor according to claim 7, wherein said second ball bearing is partly immersed in said lubricating oil held at the bottom of said container.

* * * * *